United States Patent [19]

van der Donk et al.

[11] Patent Number: 4,824,321

[45] Date of Patent: Apr. 25, 1989

[54] DEVICE FOR TURNING OVER A LENGTH OR SHEET OF FLEXIBLE MATERIAL

[75] Inventors: A. H. van der Donk, Almere; F. van den Berg, Beekbergen; J. Snoeij, Hengelo, all of Netherlands

[73] Assignee: Research-Verniging Nederlandse Kleding-Entricotage-Inds., Amsterdam, Netherlands

[21] Appl. No.: 122,901

[22] Filed: Nov. 19, 1987

[30] Foreign Application Priority Data

Nov. 20, 1986 [NL] Netherlands ..... 8602953

[51] Int. Cl.[4] ..... B65H 15/00

[52] U.S. Cl. ..... 414/757; 271/186; 414/758; 414/764; 414/784

[58] Field of Search ..... 198/402; 271/186; 414/757, 758, 764, 784, 767

[56] References Cited

U.S. PATENT DOCUMENTS 3,278,179 10/1966 Hartel ..... 271/186 X
3,357,701 12/1967 Cremer ..... 271/186 X
3,370,849 2/1968 Martin ..... 271/186 X
4,027,870 6/1977 Frech et al. ..... 271/186 X

FOREIGN PATENT DOCUMENTS 0214576 3/1987 European Pat. Off. .
1936351 1/1970 Fed. Rep. of Germany .
989490 4/1965 United Kingdom .
1055785 1/1967 United Kingdom .
1128349 9/1968 United Kingdom .

*Primary Examiner*—Robert J. Spar
*Assistant Examiner*—Janice Krizek
*Attorney, Agent, or Firm*—Harness, Dickey & Pierce

[57] ABSTRACT

Device for turning over a length (3) of flexible textile material comprising: a supporting surface (1), a turn over apparatus (4), (21,22) close above said surface (1) and having an endless work surface (4,26) of textile repelling material (13), whereby relative movement of the support surface (1) and turn over apparatus (4,21,22) is such that the surface speed of the work surface is equal to the relative horizontal displacement, and a stationary foil (10,24) lying over the top part of the work surface (4,26) starting from a pick-up plate (11,29).

20 Claims, 2 Drawing Sheets

DEVICE FOR TURNING OVER A LENGTH OR SHEET OF FLEXIBLE MATERIAL

BACKGROUND OF THE INVENTION

The invention relates to a device for turning over a length or sheet of flexible material, such as a length of textile fabric.

Such devices are known; however, they all have the drawback that they are not suitable for picking up panels of textile material already cut to a particular shape, are complicated or do not make precise positioning possible. In addition, they are generally slow.

Thus, from GB-A-1,128,349, a device is known by means of which lengths of textile fabric can be taken up from a pile by the edges of the length being clamped between a clamping plate and a roller covered with friction material, which length is then stretched taut by the opposite rotation of the rollers applied to the edges of the length to be taken up and is separated from the pile, after which the extricated length is raised up by means of said clamping means applied to the edges and transported to a conveyor belt where the length is released so that it lands on the conveyor belt. If said release takes place by both edges being set free simultaneously, the length falls onto the conveyor belt in the original position. If, on approaching the conveyor belt, the edge situated nearest at that instant is released, the latter will arrive first on the conveyor belt so that, as the other edge which is still clamped travels further, the length is turned over. The tautening of the length and the application of friction material thereto may result in damage in the case of many textile materials to be processed. The laying down takes place inaccurately, in particular if turning over has to take place. The device is complicated and operates slowly.

From DE-A-1,936,351, a device is known for turning over a length in which clamping means are applied to one edge of the length, raise said edge and then bring about the turning over by performing a horizontal movement over the support, the clamping being released at the end of said horizontal movement.

In ready-made clothing workshops, the textile material originating from a roll is deposited on long tables by means of a device with zig-zag movement in a manner such that a pile is produced. As a result of said zig-zag movement, the layers of textile material lie on top of each other with the rear sides or with the front sides of the textile material against each other in turn. From these piles, panels are cut which have to be fastened to each other by means of sewing machines to manufacture garments. The panels cut from the piles are picked up one by one with a device suitable for this purpose, an example of which is to be found in the non-prior-published Dutch Patent Application 8502400.

These panels removed from the pile have alternately to be turned over or not turned over before an operation can be carried out. The same requirement for alternately turning panels over or not turning them over arises if the panels are being processed with left-right symmetry.

If the textile material is not heaped up in a zig-zag manner and if the panels are not processed with left-right symmetry, the requirement may exist for all the panels in a pile to have to be turned over. This occurs when panels in two piles are combined. For the purpose of the further processing, the panels in piles generally have a number which corresponds to the ply of textile fabric for which the panel has been cut. If a pile is turned over as a whole and the different panels of two piles are combined, then the panels have a different number, which should be avoided in view of the possible colour differences in the textile fabric. In such cases, all the panels in a pile are turned over one by one.

Even if panels are intended to be cut in single ply, it may be necessary for panels to be turned over for the purpose of further processing.

For turning over, speed and accuracy are a first requirement in particular if it is intended to automate the manufacture of garments as much as possible. A problem in this connection is that the cut-out panels have shapes which differ from a regular shape such as a rectangle. Another problem is that the lengths which are processed successively are difficult to handle due to their large flexibility.

The problem may also arise that the lengths have different characteristics.

The object of the invention is therefore to provide a device with which it is possible to pick up a panel of any shape rapidly, turn it over and lay it down precisely in the place where that is necessary.

A further object is to provide a device which can be used universally regardless of the thickness and/or material characteristics.

SUMMARY OF THE INVENTION

According to the invention, this object is achieved in that the device consists of:

a supporting surface for a length, a turn-over apparatus which can be placed above the supporting surface, which can extend transversely across the supporting surface and which can be moved to and fro with respect to the supporting surface perpendicularly to said transverse direction and parallel to the supporting surface, which apparatus has an endless work surface which can be moved in one direction and whose lower part is at a working distance above the top surface of the supporting surface, which distance is equal to or greater than the thickness of the length to be turned over, which work surface, during the relative movement of the apparatus over the supporting surface, is driven with a circumferential speed which is essentially equal to the relative horizontal displacement speed, a stationary foil which, near the supporting surface, is attached to a fixed part of the apparatus and extends from the fixing over the upper part of the work surface of the apparatus, a pick-up plate attached to the apparatus which extends to the supporting surface from the fixing of the foil in line with the foil at an acute angle to the supporting surface in a manner such that said pick-up plate forms a feed slot with the work surface.

The length, which is placed on the preferably smooth supporting surface, will now be picked up as a result of the relative horizontal displacement of the turning-over apparatus because the pick-up plate feeds the length into the slot between foil and work surface and, in particular, at the point where the lower edge of the pick-up plate first meets the edge of the length. The length is then carried along by the moving work surface. The foil ensures that the length remains in contact with the moving work surface, the length carried along by the work surface being dragged through under the foil. Because the foil is mounted only at the pick-up edge of the roller, panels with different thicknesses can be processed without adjustment. At the end of the upper part of the work surface the length is released and is deposited on the supporting surface again at that point by the work surface, which in fact keeps on moving continuously. The length is now turned over.

When the length is picked up to turn it over, no tension at all is applied to it because the relative speed between the surface of the work surface and the length at the point of pick-up is zero.

The horizontal distance moved by the work surface and its dimensions in the circumferential direction should of course be such that panels of the lengths encountered can be picked up. The reversal of the relative horizontal movement takes place at an instant in time such that the emerging leading edge of the length arrives at the correct position on the supporting surface. For this purpose, use may be made of sensors which control the movement and ensure that the length turned over is laid down at the correct point.

The turning-over apparatus may have a second position which is at a greater distance from the supporting surface. In said position, turning over does not take place. As a result it is possible in a simple manner to turn over or not turn over a length alternatively.

For picking up a length and laying it down again, the direction of movement of the work surface remains the same. The movement of said work surface may be continuous, but does not have to be so. All this is determined by the point at which the length should be laid down.

Of course, the width of the work surface should be larger than the dimension of the length in the width direction of the work surface.

According to the invention, the work surface of the apparatus can be formed by the cylindrical surface of a roller. Such a device is simple, but the diameter of the roller is then of course determined by the dimension of the length in the relative direction of movement of the apparatus over the supporting surface.

According to the invention, the work surface of the apparatus may also be formed by an endless belt. In this embodiment, it is possible to keep the construction height of the apparatus low. In addition, at the discharge end, i.e. at the point where the length turned over is laid down on the supporting surface, a roller for the endless belt can be used whose diameter is small, so that the length released needs to bridge only a small distance when being deposited on the supporting surface.

The roller acting as work surface of the apparatus or the endless belt embodiment of the apparatus will generally perform a horizontal movement with said apparatus with respect to a horizontal stationary supporting surface, i.e. during the forward stroke of the apparatus a length is picked up and said length is deposited turned over on the supporting surface during the return stroke.

It is, however, also conceivable that the apparatus is set up in a stationary manner and the supporting surface is caused to perform the forward and return stroke.

To discharge the turned-over length it is of importance that according to the invention the work surface is covered with a textile-repelling material in order to prevent the length from continuing to cling to the work surface. In this connection, the preference is for a covering of pile material.

At the point of discharge of the length, it may be of benefit, according to the invention, that the apparatus is provided, at the side facing away from the pick-up plate, with a guide plate which is at an acute angle to the supporting surface, has a horizontal upper edge which is below the point where the work surface is intersected by a horizontal plane through the axis of rotation of the roller, and situated near the point where the length lands again on the supporting surface, and has a lower edge situated near the supporting surface. This guide plate is, in particular, of benefit it the work surface is formed by the cylindrical surface of a roller. If the roller is covered with pile material, the upper edge of the guide plate may project into the pile to some extent so that release is guaranteed.

Said guide plate may also be used if the work surface is formed by an endless belt, but loses its significance for stripping the length if the reversing roller at the discharge end has only a small diameter.

According to the invention, the pick-up plate can be formed by a part of the foil provided the latter has sufficient rigidity.

BRIEF DESCRIPTION OF THE DRAWING

The invention will now be explained in more detail by reference to the drawings.

DETAILED DESCRIPTION OF THE PREFERRED EMBODIMENT OF THE INVENTION

Figure 1:
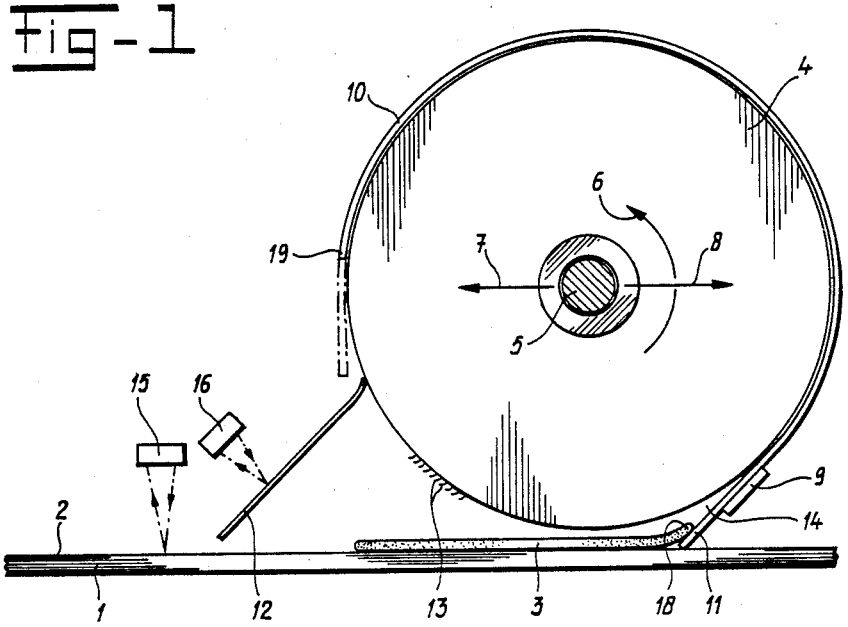
FIG. 1 shows diagrammatically a first embodiment of the device according to the invention in side view.
Figure 3:
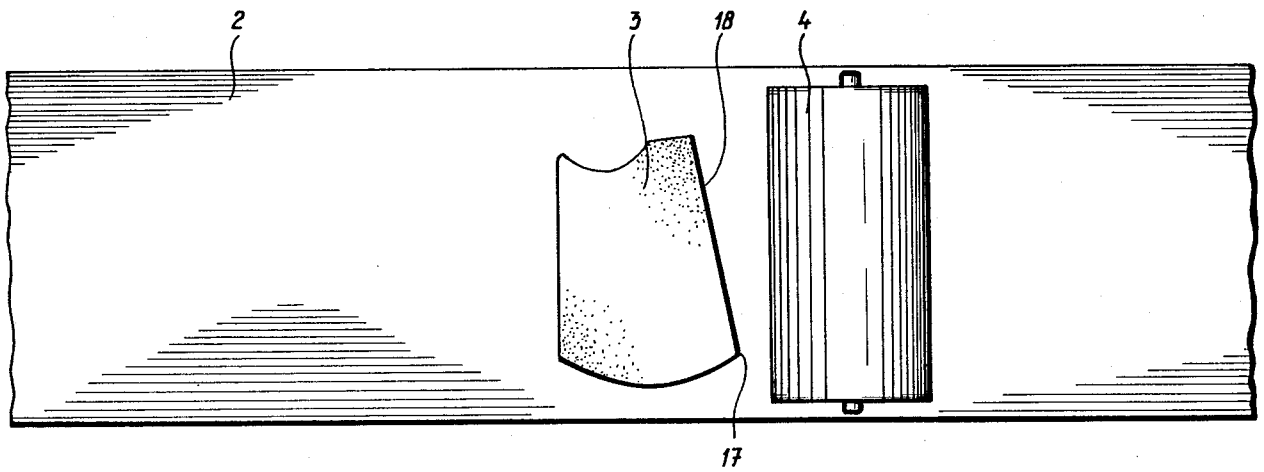
FIG. 3 shows diagrammatically the position of a length to be turned over with respect to a work surface formed by a roller.

The embodiment shown in FIG. 1 shows a supporting surface 1 with a smooth top surface 2. On this supporting surface there is laid a panel 3 which may have any outline shape, as is usual in ready-made clothing workshops. Figure 3 shows a possible shape.

Above the supporting surface 1 there is a roller 4 with a rotating spindle 5, which roller can be driven continuously in the direction of the arrow 6.

The spindle 5 is mounted with its drive in a frame which is not shown by means of which the roller can be moved horizontally in the direction of the arrow 7 or back in the direction of the arrow 8.

Said frame which is not shown contains a lath 9 on which there is mounted a foil 10 which extends downwards to the surface of the supporting surface and forms the pick-up plate 11 at that point. Said foil 10 lies over the upper section or upper part of the surface of the roller 4 which forms the work surface.

The roller may be covered with a pile material 13.

The frame not shown also supports a guide plate 12 which forms an acute angle with the horizontal supporting surface and terminates just above the top surface 2 of the supporting surface.

The pick-up plate 11 forms a feed slot 14 with the bottom of the roller.

Sensors 15 and 16 can be used to detect the presence of a length on the guide plate 12 and to determine the required position of the turned-over length and, consequently, the length of the horizontal stroke which the roller 4 must perform to and fro.

When the roller 4 moves to the left from the starting position shown in the drawing while rotating at the same time, the pick-up plate 11 will first come into contact with the point 17 (FIG. 3) of the length 3 and then gradually with the remainder of the leading edge 18 of said length. The length is then fed into the slot 14 and carried along by the work surface of the roller and thereby dragged into the space which forms between said work surface and the foil 10.

Because the horizontal speed of the roller is equal to its circumferential speed, the roller rolls, as it were, over the length without any stress being applied to the length in the process. The latater thus retains its shape and said shape also remains retained during its passage through under the foil since the foil keeps the length over the whole surface uniformly in contact with the work surface of the roller.

As a result of this, formation of folds and warping is prevented, so that the device operates faultlessly.

The end of the foil is indicated in FIG. 1 by 19. A leading edge 18 of the length released at that point will move vertically downwards, inter alia, under the influence of gravity and be picked up by the guide plate 12 which ensures that the length is moved towards the top surface 2 of the supporting surface.

The same result is achieved if the spindle 5 of the roller does not perform a to and fro stroke during its rotation as shown by the arrows 7 and 8, but remains in its position while the supporting surface performs the to and fro stroke.

The instant of reversal of the stroke is determined by the dimensions of the length in the longitudinal direction of the supporting surface and by the point at which said length has to be deposited.

Figure 2:
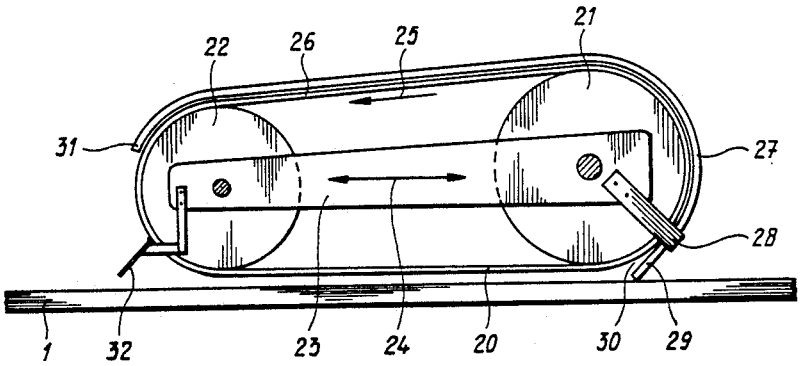
FIG. 2 shows diagrammatically a second embodiment of the device according to the invention in side view.

In the embodiment of the device according to the invention shown in FIG. 2, the work surface is formed by an endless belt 20 which runs over a roller 21 of a particular diameter and a second roller 22 of, for example, smaller diameter. Both rollers 21 and 22 are accommodated in a frame 23, shown diagrammatically, and move to and fro according to the arrows 24. The belt is driven in the direction of the arrow 25.

Over the upper part 26 of the belt 20 there is a foil 27 which is attached at 28 by means of a transverse lath to the frame 23 and has an extension 29 directed downwards which forms the feed slot 30 with the outside of the belt 20.

At the position of the roller 22, the foil terminates with the end edge 31. Beneath this there may be a guide plate 32.

This device can also function in the same manner as the device shown in FIG. 1 by to and fro movement of the apparatus as indicated by the arrows 24, or by to and fro movement of the supporting surface 1.

The device shown in FIG. 2 has a lower constructional height but greater working width than the roller. The diameter of the roller 22 at the discharge end may be small, even in a manner such that the guide plate 32 is no longer necessary for stripping. The two rollers may also be placed above each other.

The device according to the invention makes it possible to turn lengths over with great precision and at high speed. The device is appreciably simpler than any other device whatsoever and can process lengths of any shape.

Instead of a length of textile fabric, the invention is, of course, also of use if other flexible sheets such as plastic sheets are involved if theyhave to be turned over before they are joined to other sheets by welding. This occurs, for example, if the sheets are provided with an imprint and have to be turned over individually to form a sack.

We claim:

1. Device for turning over a length of flexible material, such as a length of textile fabric, consisting of; a supporting surface for the length, a turning over apparatus positioned above said supporting surface and extending transversely across said supporting surface, means for effecting relative to and fro movement of said turning over apparatus with respect to the supporting surface in a direction perpendicular to said transverse direction and parallel to said supporting surface, said turning over apparatus having an endless work surface driven in one direction and whose lower part is at a working distance above the top surface of said supporting surface, which distance is equal to or greater than the thickness of the length to be turned over, the speed at which said work surface is driven during the relative movement of said turning over apparatus over said supporting surface speed being essentially equal to the relative displacement speed between said work surface and said turning over apparatus, a foil which is located above said work surface to form a space between the work surface and the foil and which includes a pick-up plate attached to said turning over apparatus and extending toward said supporting surface at an acute angle to said supporting surface which forms a feed slot with the work surface for picking up a length from said supporting surface upon relative movement between said turning-over apparatus and said supporting surface transferring said length into the space between said work surface and said foil and depositing said length in inverted orientation back onto said supporting surface.

2. Device according to claim 1, characterized in that the work surface of the turning-over apparatus is formed by the cylindrical surface of a roller.

3. Device according to claim 1, characterized in that the work surface of the turning-over apparatus is formed by an endless belt.

4. Device according to claim 2, characterized in that the work surface is covered with a textile-repelling material.

5. Device according to claim 4, characterized in that the work surface is covered with a pile material.

6. Device according to claim 1 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

7. Device according to claim 1, characterized in that the pick-up plate is formed by a part of the foil.

8. Device according to claim 3, characterized in that the work surface is covered with a textile-repelling material.

9. Device according to claim 8, characterized in that the work surface is covered with a pile material.

10. Device according to claim 2 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

11. Device according to claim 3 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

12. Device according to claim 4 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

13. Device according to claim 5 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

14. Device according to claim 8 characterized in that the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

15. Device according to claim 9 characterized inthat the turning-over apparatus is provided, at the side facing away from the pick-up plate with a guide plate extending at an acute angle to the supporting surface, said guide plate having a horizontal upper edge which is adjacent said work surface and having a lower edge situated near the supporting surface.

16. Device according to claim 2, characterized in that the pick-up plate is formed by a part of the foil.

17. Device according to claim 3, characterized in that the pick-up plate is formed by a part of the foil.

18. Device according to claim 4, characterized in that the pick-up plate is formed by a part of the foil.

19. Device according to claim 5, characterized in that the pick-up plate is formed by a part of the foil.

20. Device according to claim 6, characterized in that the pick-up plate is formed by a part of the foil.

* * * * *

UNITED STATES PATENT AND TRADEMARK OFFICE

CERTIFICATE OF CORRECTION

PATENT NO. : 4,824,321

DATED : April 25, 1989

INVENTOR(S) : van der Donk, et al

It is certified that error appears in the above-identified patent and that said Letters Patent is hereby corrected as shown below:

Column 3, line 25, "alternatively" should be —alternately—.

Column 4, line 9, "it" should be —if—.

Column 5, line 11, "latater" should be —latter—.

Column 5, line 67, "theyhave" should be —they have—.

Column 6, line 20, Claim 1, delete "speed".

Column 8, line 4, Claim 15, "inthat" should be —in that—.

Signed and Sealed this

Seventh Day of April, 1992

*Attest:*

HARRY F. MANBECK, JR.

*Attesting Officer*

*Commissioner of Patents and Trademarks*